US009233418B2

(12) United States Patent
Ederyd et al.

(10) Patent No.: US 9,233,418 B2
(45) Date of Patent: Jan. 12, 2016

(54) CAST-IN CEMENTED CARBIDE COMPONENTS

(75) Inventors: Stefan Ederyd, Saltsjö-Boo (SE); Per Quarfordt, Storfors (SE)

(73) Assignee: Sandvik Intellectual Property AB, Sandviken (SE)

( * ) Notice: Subject to any disclaimer, the term of this patent is extended or adjusted under 35 U.S.C. 154(b) by 616 days.

(21) Appl. No.: 12/267,059

(22) Filed: Nov. 7, 2008

(65) Prior Publication Data

US 2009/0148336 A1 Jun. 11, 2009

(30) Foreign Application Priority Data

Nov. 9, 2007 (SE) ..... 0702488

(51) Int. Cl.

| | |
|---|---|
| ***C22C 29/02*** | (2006.01) |
| ***B22D 19/06*** | (2006.01) |
| ***B22D 19/02*** | (2006.01) |
| ***C22C 38/02*** | (2006.01) |
| ***C22C 38/04*** | (2006.01) |
| ***C22C 38/44*** | (2006.01) |

(52) U.S. Cl.

CPC ..... *B22D 19/06* (2013.01); *B22D 19/02* (2013.01); *C22C 38/02* (2013.01); *C22C 38/04* (2013.01); *C22C 38/44* (2013.01)

(58) Field of Classification Search

None

See application file for complete search history.

(56) References Cited

U.S. PATENT DOCUMENTS

| | | | | | |
|---|---|---|---|---|---|
| 4,024,902 | A | * | 5/1977 | Baum | 164/97 |
| 4,101,318 | A | | 7/1978 | Rudy | |
| 4,119,459 | A | | 10/1978 | Ekemar et al. | |
| 4,584,020 | A | | 4/1986 | Waldenström | |
| 4,608,318 | A | | 8/1986 | Makrides et al. | |
| 5,066,546 | A | * | 11/1991 | Materkowski | 428/627 |
| 5,337,801 | A | | 8/1994 | Materkowski | |
| 5,785,109 | A | | 7/1998 | Hongawa | |
| 6,033,791 | A | | 3/2000 | Smith et al. | |
| 6,171,713 | B1 | | 1/2001 | Smith et al. | |

FOREIGN PATENT DOCUMENTS

| | | | | |
|---|---|---|---|---|
| DE | 35 15 975 | | 12/1985 | |
| EP | 1 048 750 | A1 | 4/2000 | |
| EP | 1 798 310 | A2 | 6/2007 | |
| JP | 06-218520 | * | 8/1994 | B22D 19/00 |
| JP | 6-218520 | | 8/1994 | |
| JP | 07-214288 | | 8/1995 | |
| JP | 2000-352292 | | 12/2000 | |
| JP | 2001-001203 | A | 1/2001 | |

(Continued)

OTHER PUBLICATIONS

SubsTech, http://www.substech.com/dokuwiki/doku.php?id=carbon_steel_sae_1010 (2002).*

(Continued)

*Primary Examiner* — Yoshitoshi Takeuchi

(74) *Attorney, Agent, or Firm* — Morgan, Lewis & Bockius LLP

(57) ABSTRACT

The present invention relates to a compound body comprising cemented carbide and steel with a carbon content corresponding to a carbon equivalent Ceq=wt-% C+0.3(wt-% Si+wt-% P) of from about 0.1 to about 0.85 wt-%. The body is particularly useful for earth moving tools e.g. dredge cutter heads.

12 Claims, 2 Drawing Sheets

(56) References Cited

FOREIGN PATENT DOCUMENTS

| | | |
|---|---|---|
| JP | 2007-190669 A | 8/2007 |
| WO | WO 03/049889 | 6/2003 |

OTHER PUBLICATIONS

Jingxin Alloy, http://www.carbidechina.com/carbide.html.*
Tungsten Carbide—An Overview, Azom (http://www.azom.com/article.aspx?ArticleID=1203 (2002)).*
ASM Alloy Center Database S48C, (2001).*
ASM Alloy Center Database SAE 1010 (1995).*
English translation of JP 06-218520 (1994).*
Office Action for Canadian Application No. 2,704,068, dated Feb. 4, 2015.
Office Action for Japanese Patent Application No. 2010-533041—Issued on Oct. 30, 2012 including English Translation of Notice of Reasons for Rejection.
Communication dated Mar. 10, 2015 and Examination dated Mar. 24, 2015, from the European Patent Office in counterpart EP Application No. 08846660.2-1362 / 2219807. Note: JP 06-218520 is already of record.
Office Action for Canadian Application No. 2,704,068, dated Aug. 26, 2015.
Office Action for European Application No. 08 846 660.2-1362, dated Sep. 14, 2015.

* cited by examiner

CAST-IN CEMENTED CARBIDE COMPONENTS

CROSS-REFERENCE TO PRIOR APPLICATION

This application claims priority to Sweden Application No. SE 0702488-8 filed Nov. 9, 2007, which is incorporated by reference herein.

BACKGROUND OF THE INVENTION

The present invention relates to cemented carbide components which are cast into low carbon steel. The components are especially suitable for roller cone bits, impact rock crusher arm/impellers, point attack tools, dredging teeth and sliding wear parts.

U.S. Pat. No. 4,119,459 discloses a composite body with cemented carbide and a matrix of graphitic cast iron-base alloy with a carbon content of 2.5-6%. U.S. Pat. No. 4,584,020 and U.S. Pat. No. 5,066,546 claim that the steel matrix should have a carbon content between 1.5 and 2.5%. U.S. Pat. No. 4,608,318 discloses a powder metallurgical method to obtain composite material bodies during solid state sintering and bonding the metal compact to said compact. U.S. Pat. No. 6,171,713 describes a composite of white iron alloys and cemented carbide-granules. The melting point is 1480-1525° C. WO 03/049889 describes consolidated hard materials, method of manufacture and applications. The consolidation takes place below the liquidus temperature of the binder metal using rapid omnidirectional compaction (ROC) or hot isostatic pressing (HIP).

The ductile cast iron used in the prior art has generally a low hardness of about 38 HRC and low alloy steel casting has a hardness of between 40 and 53 HRC. Thus the matrix of a low alloy steel will have about twice the strength of a comparable cast iron product according to prior art.

From the above cited prior art it is evident that cemented carbide is preferably cast into an iron alloy with relatively high carbon content to form a body which body is subsequently cast into an iron alloy with lower carbon content, e.g., U.S. Pat. No. 4,584,020 and U.S. Pat. No. 5,066,546.

OBJECTS AND SUMMARY OF THE INVENTION

It is an object of the present invention to provide a steel body with cast-in cemented carbide with improved wear properties.

It is also an object of the present invention to provide a casting method for making the body.

In one aspect of the invention, there is provided a compound body comprising cemented carbide and steel wherein the steel has a carbon content corresponding to a carbon equivalent Ceq=wt-% C+0.3(wt-% Si+wt-% P), of less than about 0.9 wt-% but more than about 0.1 wt-%.

In another aspect of the present invention, there is provided a method of casting comprising fixing a cemented carbide part in a mold and pouring melted steel into the mold, wherein the steel has a carbon content corresponding to a carbon equivalent Ceq=wt-% C+0.3(wt-% Si+wt-% P) of less than about 0.9 wt-%.

In the figures

Figure 1:
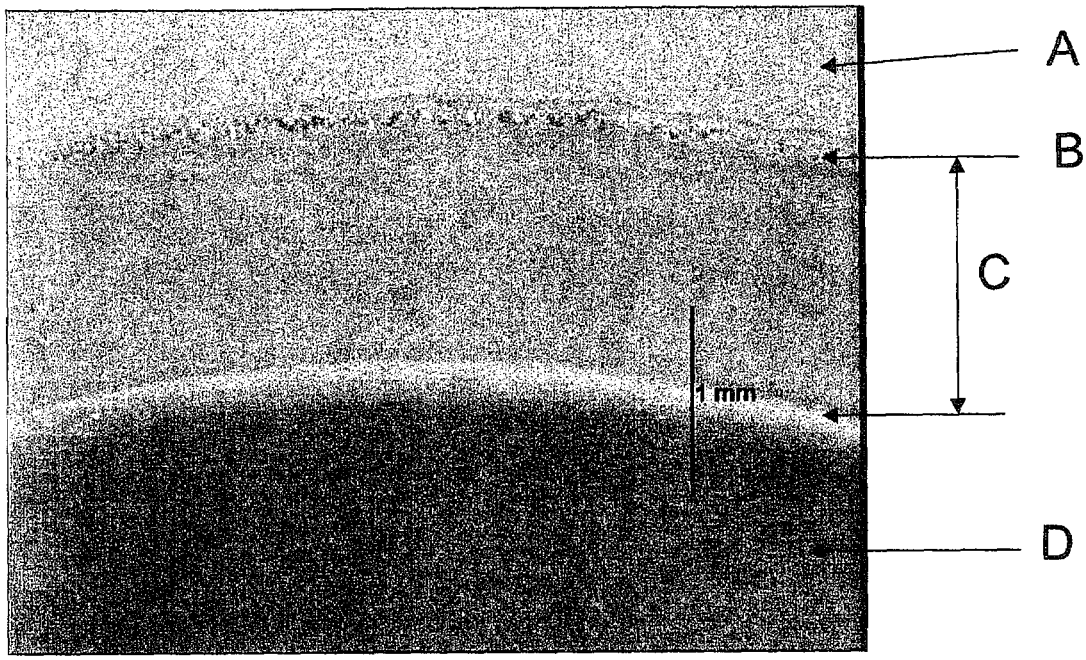
FIG. 1 is a light optical micrograph of the transition zone cemented carbide/steel after etching with Murakami and Nital.

A—steel,

B—eta-phase zone,

C—transition zone in the cemented carbide,

D—unaffected cemented carbide and

E—carbon enriched zone in the steel.

DETAILED DESCRIPTION OF A PREFERRED EMBODIMENT OF THE INVENTION

It has now been found that a product with improved performance can be obtained if cemented carbide is cast in a steel with low carbon content by casting at a very well controlled temperature during the casting procedure and using a cemented carbide with a carbon content close to graphite formation.

According to invention there is now provided a wear resistant component of a cemented carbide body cast-in low alloy carbon steel with various configurations and shapes.

The steel has a composition with a carbon equivalent Ceq=wt-% C+0.3(wt-% Si+wt-% P), of less than about 0.9 wt-%, preferably less than about 0.8 wt-%, but, however, greater than about 0.1, preferably greater than about 0.5, wt-%. Preferably, the steel is composed of a Cr, Ni, Mo low alloy steel material with a melting point of about 1450 to about 1550° C. The hardness of the steel is between about 45 and about 55 HRC.

The invention is applicable to WC-based cemented carbides with a binder phase of Co and/or Ni preferably with a carbon content close to formation of free graphite which in case of a cemented carbide with cobalt binder phase means that the magnetic cobalt content is from about 0.9 to about 1.0 of the nominal cobalt content. The hardness of the cemented carbide is from about 800 to about 1750 HV3. Up to about 5 wt-% of carbides of the elements Ti, Cr, Nb, Ta, V can be present.

In a first embodiment aimed for earth moving tools, e.g., dredge cutter heads, the cemented carbide has a binder phase content of from about 10 to about 25 wt-% Co and/or Ni with WC having a grain size between about 0.5 and about 7 μm.

In a second embodiment aimed especially for rock milling bit cutters, e.g., tooth type three cone bits for rotary drilling, the cemented carbide has a binder phase content of from about 9 to about 15 wt-% Co and/or Ni in WC with a grain size between about 2 and about 10 μm.

In a third embodiment aimed especially for rock milling tools, e.g., point attack tools, the cemented carbide has a binder phase content of from about 5 to about 9 wt-% Co and/or Ni with WC with a grain size between about 2 and about 15 μm.

In a fourth embodiment aimed especially for crusher arms or paddles in crushers, e.g., ore and oilsand, the cemented carbide has a binder phase content of from about 10 to about 25 wt-% Co and/or Ni in WC with a grain size between about 2 and about 10 μm.

The transition zone between the cemented carbide and the steel exhibits a good bond essentially free of voids and cracks. A few cracks in the zone between the steel and the cemented carbide will, however, not seriously affect performance of the product.

In the transition zone, there is a thin eta-phase zone with a thickness between about 50 and about 200 μm (B). In the cemented carbide adjacent to the eta-phase zone, there is an iron containing transition zone with a width of about 0.5 to about 2 mm (C). In the steel adjacent to the eta-phase zone there in a zone with enriched carbon content (E) with a width of between about 10 and about 100 μm.

According to the casting method, the cemented carbide part is fixed in a mold and melted steel is poured into the mold. The temperature of the melt during the pouring is between about 1550 and about 1650° C. Preferably, the cemented carbide body is pre-heated by allowing the melt passing through the mold round the cemented carbide body. Cooling is performed in free air. After the casting, conventional types of heat treatment are performed in order to harden and anneal the steel.

The steel according to the invention exhibits good bonding to the cemented carbide. This good bonding is due to the combination of the steel type with low carbon content exhibiting a decarburizing of the outer part of the cemented carbide to form the microstructure within the cemented carbide and the steel without brittle hard phases. The thin eta-phase zone does not affect the brittleness of the cast product. To exhibit this structure, the melting temperature of the steel during the casting should be slightly higher than the melting point of the binder phase of the cemented carbide in the surface zone of the cemented carbide body.

The invention is additionally illustrated in connection with the following examples, which are to be considered as illustrative of the present invention. It should be understood, however, that the invention is not limited to the specific details of the examples.

Example 1

Cylindrical rods of cemented carbide, with a diameter of 22 mm and length 120 mm with a composition of 5 wt-% Ni and 10 wt-% Co and rest WC with a grain size of 4 μm were prepared by conventional powder metallurgical techniques. The carbon content was 5.2 wt % and the hardness 1140 HV3.

The rods were fixed in molds for the manufacturing of dredge teeth to fit the VOSTA T4 system for use in dredge cutter heads. A steel of type CNM85 with a composition of 0.26% C, 1.5% Si, 1.2% Mn, 1.4% Cr, 0.5% Ni, 0.2% Mo, Ceq=0.78, was melted and the melt was poured into the molds at a temperature of 1570° C. The cemented carbide body was pre-heated by allowing the melt passing through the mold round the cemented carbide body. After cooling in air, the teeth were normalized at 950° C. and hardened at 920° C. Annealing at 250° C. was the final heat treatment step before grinding to final shape.

Figure 2:
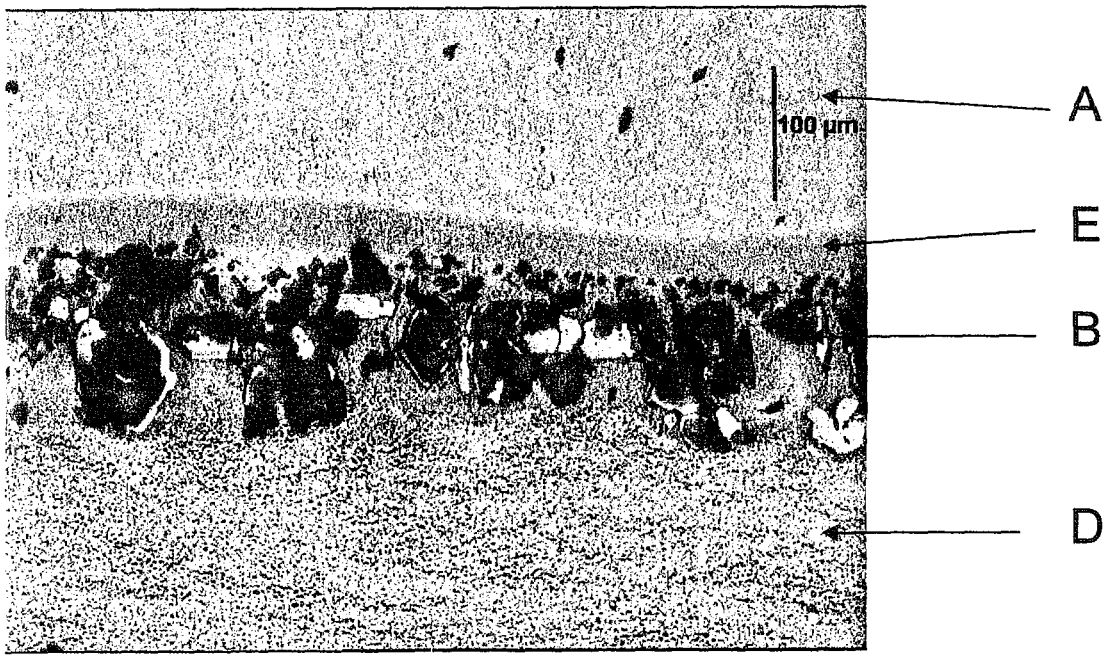
FIG. 2 is similar but in higher magnification.
Figure 3:
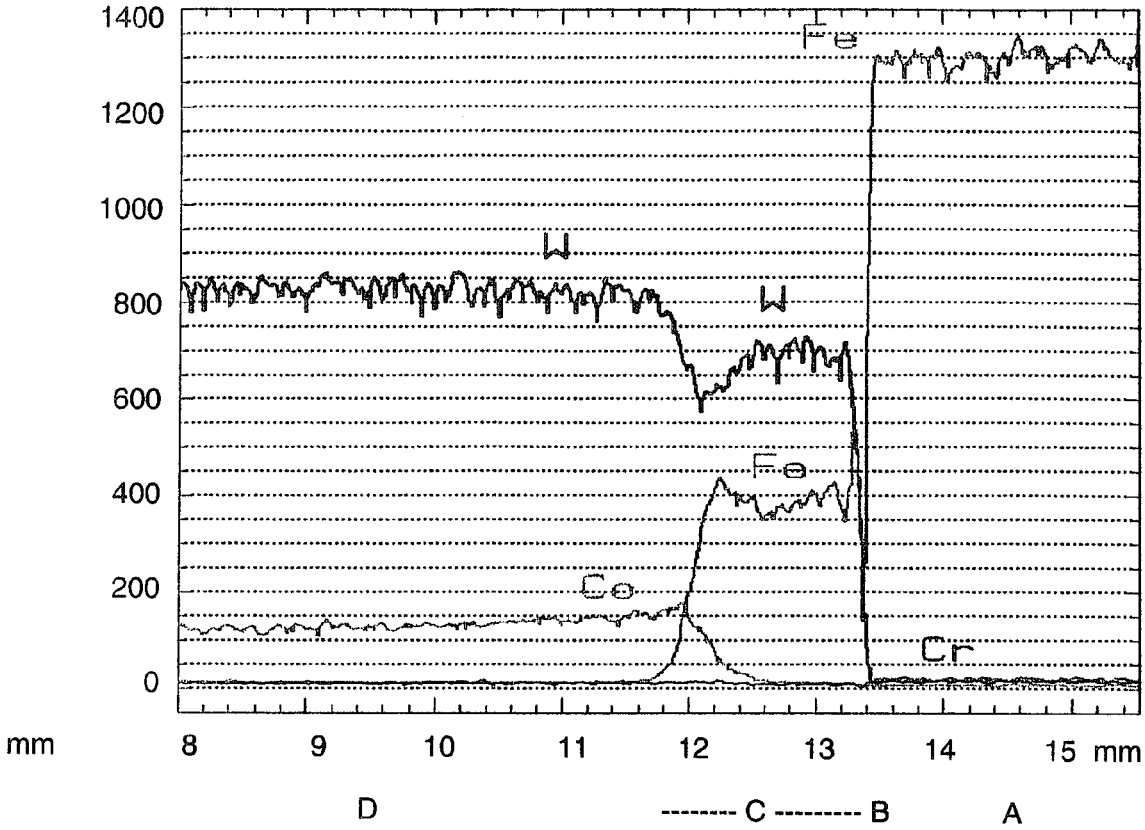
FIG. 3 shows the distribution of W, Co, Fe and Cr along a line perpendicular to the transition zone.

One tooth was chosen for metallurgical investigation of the transition zone cemented carbide/steel of the tooth. A cross section of the tooth was prepared by cutting, grinding and polishing. The transition zone cemented carbide/steel was examined in a light optical microscope, LOM. The LOM study was made on unetched as well as Murakami and Nital etched surface, see FIG. 1 and FIG. 2. The bond between the steel and the cemented carbide was good and essentially without voids or cracks. Between the cemented carbide and the steel there was an eta-phase zone 100 μm thick, B. In the cemented carbide there was an iron containing transition zone, C, with a thickness of 1.5 mm on top of the unaffected cemented carbide, D. In the steel there is a carbon enriched zone 50 μm thick, E. The distribution of W, Co, Fe and Cr over the transition zone was also examined by microprobe analysis. It was found that the transition zone, C, consists essentially of WC in a Fe-binder phase, see FIG. 3.

Example 2

Example 1 was repeated with bodies of two cemented carbide grades. One grade had a composition of 15 wt-% Co, rest WC with a grain size of 3 μm, a magnetic Co content of 14 wt-% and a hardness of 1070 HV3. The other grade had a composition of 10 wt-% Co, rest WC with a grain size of 4 μm, a magnetic Co content of 9.6 wt-% and a hardness of 1175 HV3. The cemented carbide bodies were in this case cylindrical chisel shaped buttons with an outer diameter of 18 mm.

Before the casting, the buttons were fixed in a suitable mold in such a way that a conical cutter was obtained. The buttons with the lower Co content was fixed in the outer radius of the cone and the inner top position had buttons with the higher Co content. After the heat treatment and grinding the cones were provided with a bore for the bearing. The finished cutters were examined in the same way as in example 1 with essentially the same results.

Example 3

Example 1 was repeated with a grade with a composition of 20 wt-% Co, rest WC with a grain size of 2 μm. The magnetic Co content was 18.4 wt-% and the hardness 900 HV3.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A compound body comprising:

cemented carbide including a cobalt binder phase, wherein the cobalt binder phase has a magnetic cobalt content of 0.9 to 1.0 of the nominal cobalt content;

a low carbon steel surrounding the cemented carbide, wherein the steel has a carbon content corresponding to a carbon equivalent Ceq=wt-% C+0.3(wt-% Si+wt-% P) of less than 0.9 wt-% but more than 0.5 wt-%, and a transition zone between the cemented carbide and steel, wherein the transition zone includes an eta-phase zone with a thickness between 50 and 200 μm, wherein, in the cemented carbide adjacent to the eta-phase zone, there is an iron containing transition zone and wherein, in the steel adjacent to the eta-phase zone, there is a zone with enriched carbon content.

2. The compound body of claim 1 wherein the carbon equivalent Ceq is less than 0.8 wt-%.

3. The compound body of claim 1 wherein the body is an earth moving tool, the cemented carbide has a binder phase content of from 10 to 20 wt-% Co and/or Ni with WC with a grain size between 0.5 and 7 μm.

4. The compound body of claim 1 wherein the body is a rock milling bit cutter, the cemented carbide has a binder phase content of from 9 to 15 wt-% Co and/or Ni in WC with a grain size between 2 and 10 μm.

5. The compound body of claim 1 wherein the body is a rock milling tool, the cemented carbide has a binder phase content of from 5 to 9 wt-% Co and/or Ni with WC with a grain size between 2 and 15 μm.

6. The compound body of claim 1 wherein the body is a crusher arm or a paddle in a crusher, the cemented carbide has a binder phase content of from 10 to 25 wt-% Co and/or Ni in WC with a grain size between 2 and 10 μm.

7. The compound body of claim 1, wherein the iron containing transition zone has a width of from 0.5 to 2 mm.

8. The compound body of claim 1, wherein the zone with enriched carbon content has a width of between 10 and 100 μm.

9. A compound body comprising:

cemented carbide including a cobalt binder phase, wherein the cobalt binder phase has a magnetic cobalt content of 0.9 to 1.0 of the nominal cobalt content; and a low carbon steel, wherein the steel has a carbon content corresponding to a carbon equivalent Ceq=wt-% C+0.3 (wt-% Si+wt-% P) of less than 0.8 wt-% but more than 0.5 wt-%, wherein the steel surrounds the cemented carbide and the compound body further comprises:

a transition zone cemented carbide/steel including a thin eta-phase zone with a thickness between 50 and 200 μm, in the cemented carbide adjacent to the eta-phase zone, an iron containing transition zone with a width of from 0.5 to 2 mm, and in the steel adjacent to the eta-phase zone, a zone with enriched carbon content with a width of between 10 and 100 μm.

10. Method of casting a compound body, comprising:

fixing a cemented carbide part in a mold;

pouring melted steel into the mold to form a casting; and cooling the casting in free air, wherein the cemented carbide part includes a cobalt binder phase and wherein the cobalt binder phase has a magnetic cobalt content of 0.9 to 1.0 of the nominal cobalt content, wherein the steel is a low carbon steel having a carbon content corresponding to a carbon equivalent Ceq=wt-% C+0.3(wt-% Si+wt-% P) of less than 0.9 wt-% but more than 0.5 wt-%, wherein the temperature of the melted steel during the pouring is between from about 1550 to about 1650° C., wherein the method forms a transition zone between the cemented carbide and steel in the compound body, wherein the transition zone includes an eta-phase zone with a thickness between 50 and 200 μm, wherein, in the cemented carbide adjacent to the eta-phase zone, there is an iron containing transition zone, and wherein, in the steel adjacent to the eta-phase zone, there is a zone with enriched carbon content.

11. The method of claim 10 wherein the carbon equivalent Ceq is less than 0.8 wt-%.

12. The method of claim 10 wherein a heat treatment is performed after the casting in order to harden and anneal the steel.

* * * * *